US010813396B2

(12) United States Patent
Chrzanowska

(10) Patent No.: US 10,813,396 B2
(45) Date of Patent: Oct. 27, 2020

(54) BODY FITTING TOWEL

(71) Applicant: Bozena M. Chrzanowska, Garrison, NY (US)

(72) Inventor: Bozena M. Chrzanowska, Garrison, NY (US)

( * ) Notice: Subject to any disclaimer, the term of this patent is extended or adjusted under 35 U.S.C. 154(b) by 0 days.

(21) Appl. No.: 14/928,518

(22) Filed: Oct. 30, 2015

(65) Prior Publication Data

US 2016/0192719 A1 Jul. 7, 2016

Related U.S. Application Data

(63) Continuation-in-part of application No. 14/544,445, filed on Jan. 7, 2015.

(51) Int. Cl.

| | |
|---|---|
| ***A41D 7/00*** | (2006.01) |
| ***A41D 15/04*** | (2006.01) |
| ***A47K 10/02*** | (2006.01) |

(52) U.S. Cl.

CPC ..... *A41D 15/04* (2013.01); *A41D 7/006* (2013.01); *A41D 7/008* (2013.01); *A47K 10/02* (2013.01)

(58) Field of Classification Search

CPC ..... A41D 7/006; A41D 7/008

USPC ..... 2/69.5, 88, 89

See application file for complete search history.

(56) References Cited

U.S. PATENT DOCUMENTS 1,467,718 A * 9/1923 Entrikin ..... A41D 7/008 2/88
2,154,227 A * 4/1939 Brown ..... A41D 1/22 2/74
2,344,010 A * 3/1944 Walsh ..... A41D 7/008 190/1
2,420,344 A * 5/1947 Alexander ..... A47G 9/064 2/69
2,458,062 A * 1/1949 Davenport ..... A41D 7/008 2/69
2,469,302 A * 5/1949 Kelleher ..... A41D 7/008 2/219
2,621,331 A * 12/1952 Loretto ..... A41D 7/008 2/75
2,626,648 A * 1/1953 Anderson ..... A45C 3/10 15/210.1
2,717,390 A * 9/1955 Houze ..... A41D 15/00 2/105
2,971,198 A * 2/1961 Tomich ..... A41D 3/08 2/84
3,218,649 A * 11/1965 Ricter ..... A41D 13/1209 2/114
3,590,864 A * 7/1971 Vechesloff ..... A41D 15/04 135/115
4,180,867 A * 1/1980 Ridgeway, Jr. ..... A41D 15/04 135/96

(Continued)

*Primary Examiner* — Clinton T Ostrup
*Assistant Examiner* — Cameron A Carter

(57) ABSTRACT

A towel for use after a shower, a bath, or a swim. The towel is arranged to stay closed about a wearer's body and at the same time allows his or her hands to be free. The towel affords the wearer privacy when changing clothing, for example, in a locker room. Also, when tied about the wearer, the towel allows him or her to sit comfortably on hot ground at the beach or other outdoor swim area. The towel can also be worn as a garment with an attractive and elegant appearance, and serve a number of other useful and desirable functions.

8 Claims, 6 Drawing Sheets

(56) References Cited

U.S. PATENT DOCUMENTS 5,441,789 A * 8/1995 Walker ..... A47C 1/143 297/223
5,694,643 A * 12/1997 Fujiwara ..... A41D 7/008 2/109
5,756,177 A * 5/1998 Cheong ..... A41D 7/006 2/69
6,185,743 B1 * 2/2001 Mick ..... A41D 3/08 2/69
7,444,685 B2 11/2008 Rose
7,634,818 B1 * 12/2009 Trujillo ..... A41B 13/00 2/269
8,042,195 B1 * 10/2011 Massey ..... A47G 9/062 2/69
8,359,687 B2 * 1/2013 Marlowe ..... A47D 15/005 128/872
2003/0196240 A1 * 10/2003 Meacham ..... A41D 7/008 2/69
2005/0044606 A1 * 3/2005 Flanagan-Frazier ..... A41D 7/006 2/69
2007/0130666 A1 * 6/2007 Giglio ..... A41D 7/008 2/69
2007/0204375 A1 * 9/2007 Issel ..... A41D 7/008 2/69
2007/0283481 A1 * 12/2007 Rawlings ..... A41D 7/008 2/114
2007/0289061 A1 * 12/2007 Dumoulin ..... A41D 7/008 5/417
2009/0025119 A1 * 1/2009 Nespor ..... A41D 7/008 2/84
2009/0106873 A1 * 4/2009 Whiteside ..... A47K 10/02 2/69
2009/0144874 A1 * 6/2009 Stein ..... A41D 15/04 2/69
2009/0144878 A1 * 6/2009 Mina ..... A41D 7/008 2/114
2009/0288264 A1 * 11/2009 Banasik ..... A41D 7/008 15/209.1
2009/0293168 A1 * 12/2009 Lugtu ..... A41D 7/006 2/69
2011/0305866 A1 * 12/2011 Stowe ..... A47G 9/062 428/100
2012/0096618 A1 * 4/2012 Mashkevich ..... A41D 7/008 2/69
2013/0239290 A1 * 9/2013 Rossi ..... A41D 7/008 2/84
2014/0123362 A1 * 5/2014 Seitz ..... A41D 7/008 2/69
2014/0150156 A1 * 6/2014 Sprague ..... A47K 10/02 2/69
2014/0165254 A1 * 6/2014 Bowen ..... A47K 10/02 2/69
2015/0296898 A1 * 10/2015 Bowen ..... A47K 10/02 2/69
2015/0305411 A1 * 10/2015 Caco ..... A41D 1/22 2/69

* cited by examiner

BODY FITTING TOWEL

CROSS REFERENCE TO RELATED APPLICATION

This application is a continuation-in-part of my copending U.S. patent application Ser. No. 14/544,445 filed Jan. 7, 2015, titled Body Fitting Towel and which is incorporated by reference in its entirety.

BACKGROUND OF THE INVENTION

Field of the Invention

The present invention relates to bath and beach towels, and particularly to a towel construction that offers certain desirable features in addition to drying the wearer's body.

Discussion of the Known Art

U.S. Pat. No. 6,185,743 (Feb. 13, 2001) discloses a beach tog a that is claimed to be capable of converting to fashionable dress attire. Further, U.S. Pub. No. 2013/0239290 (Sep. 19, 2013) describes a towel having a hood fixed to a top edge, and at least one pocket attached to the interior of the towel which is accessible to the user when the towel is wrapped about the torso. See also U.S. Pat. No. 7,444,685 (Nov. 4, 2008). All relevant portions of the foregoing references are incorporated herein by reference.

Notwithstanding the known art, the is a need for a towel which, in addition to drying and protecting the wearer, can be made to conform with the wearer's body at more than one location while maintaining an attractive and elegant appearance, and to serve other useful functions as well.

SUMMARY OF THE INVENTION

According to the invention, a towel includes a generally rectangular absorbent fabric material having a pair of opposed long edges and a pair of opposed short edges. First and second sleeves are formed on the fabric material next to corresponding long edges of the material, wherein each sleeve opens at the opposed short edges of the material. A ribbon is disposed inside each sleeve such that the opposite ends of each ribbon are accessible to a user at the open ends of the sleeve. Each ribbon is stitched to the fabric material at two locations over the length of the sleeve in which the ribbon is disposed. Thus, the fabric material is prevented from gathering to a determined extent when the opposite ends of each ribbon are accessed by the user and tied to one another.

For a better understanding of the invention, reference is made to the following description taken in conjunction with the accompanying drawing and the appended claims.

DETAILED DESCRIPTION OF THE INVENTION

Figure 1:
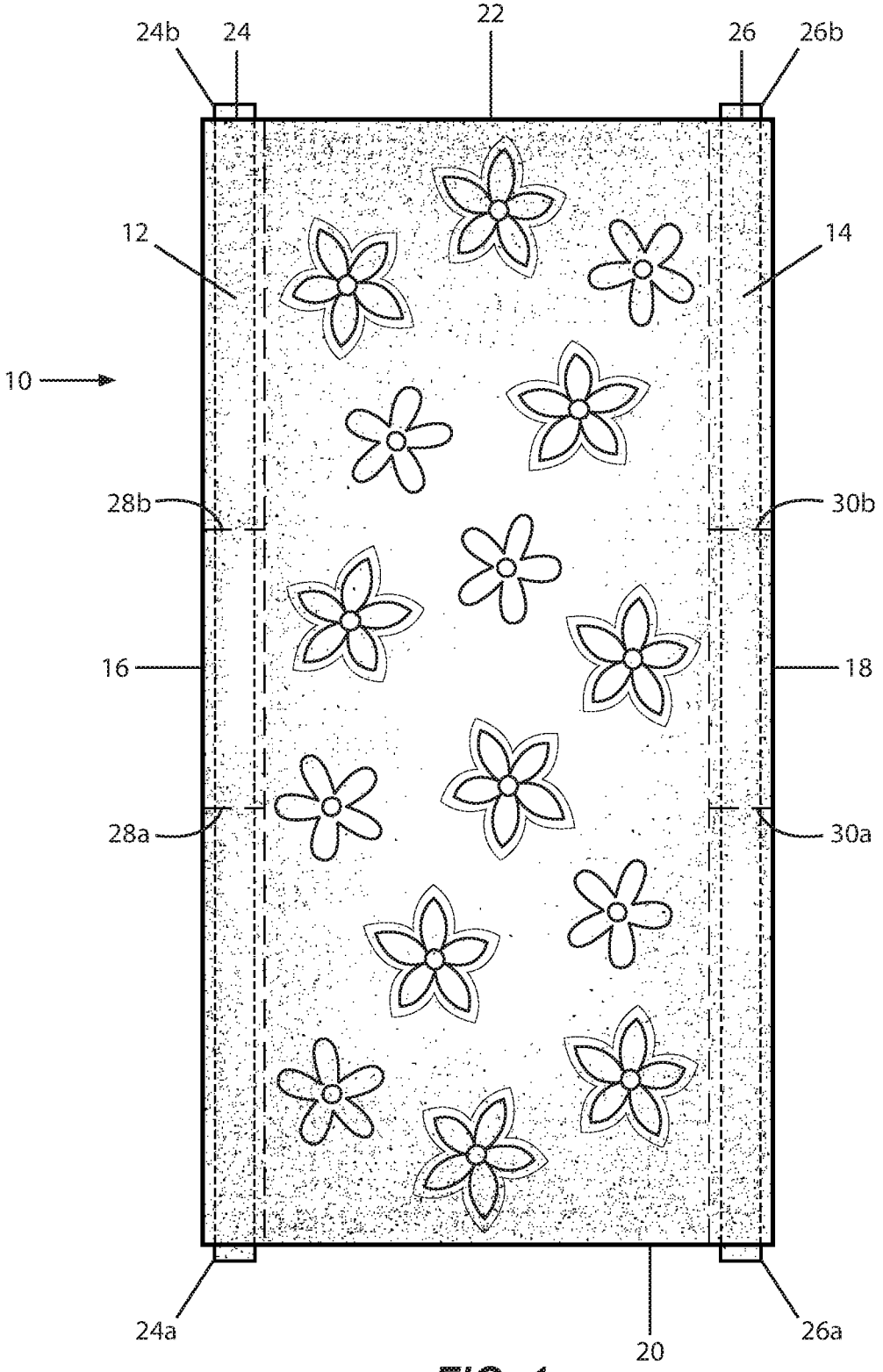
FIG. 1 is a plan view of a towel according to the invention, as seen from a front side of the towel.
Figure 2:
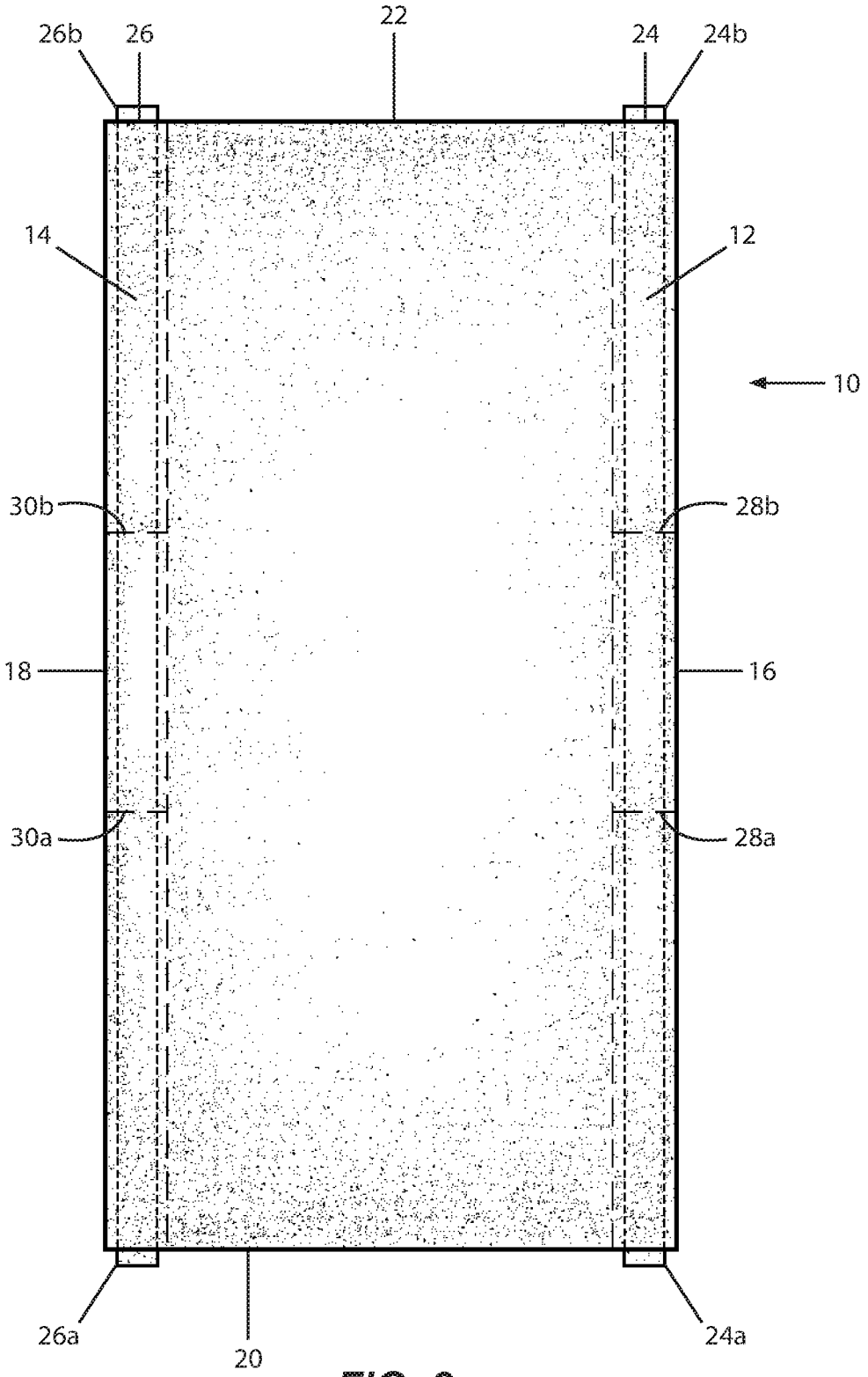
FIG. 2 is a perspective view of the towel in FIG. 1, as seen from the back side of the towel.
Figure 3:
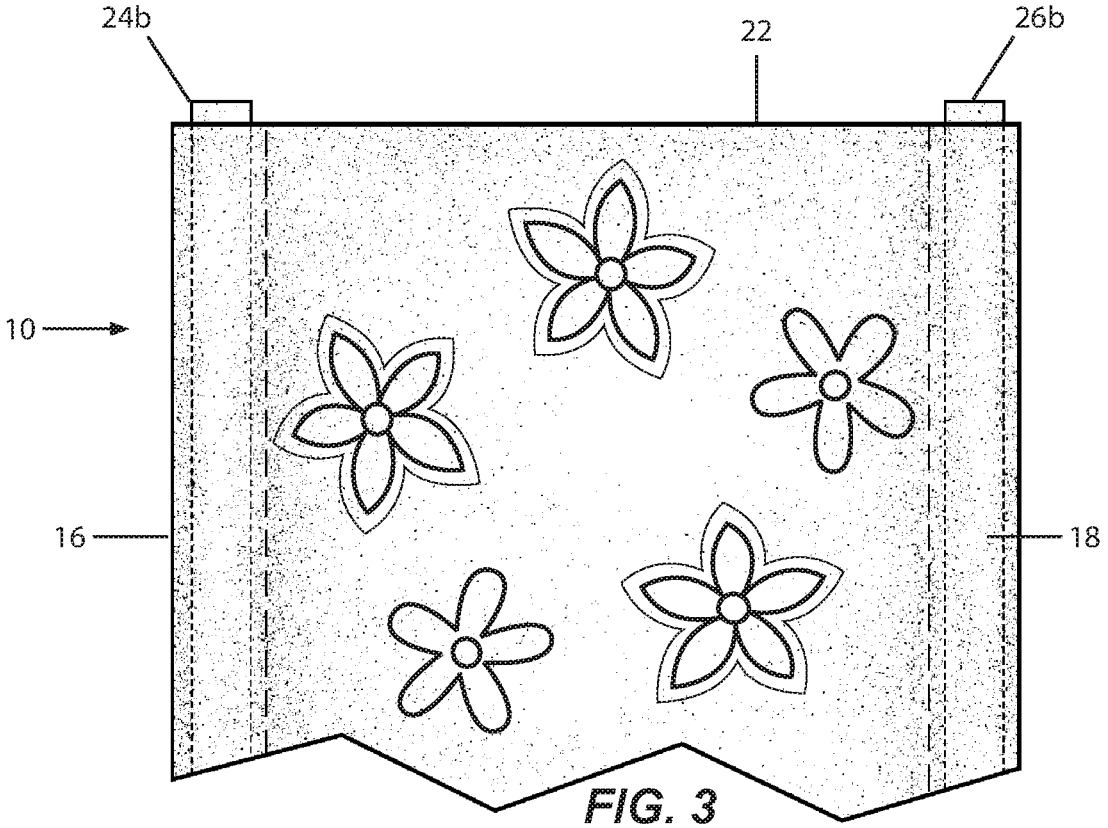
FIG. 3 is an enlarged, plan view of a right end portion of the towel in FIG. 1, as seen from the front side of the towel.
Figure 4:
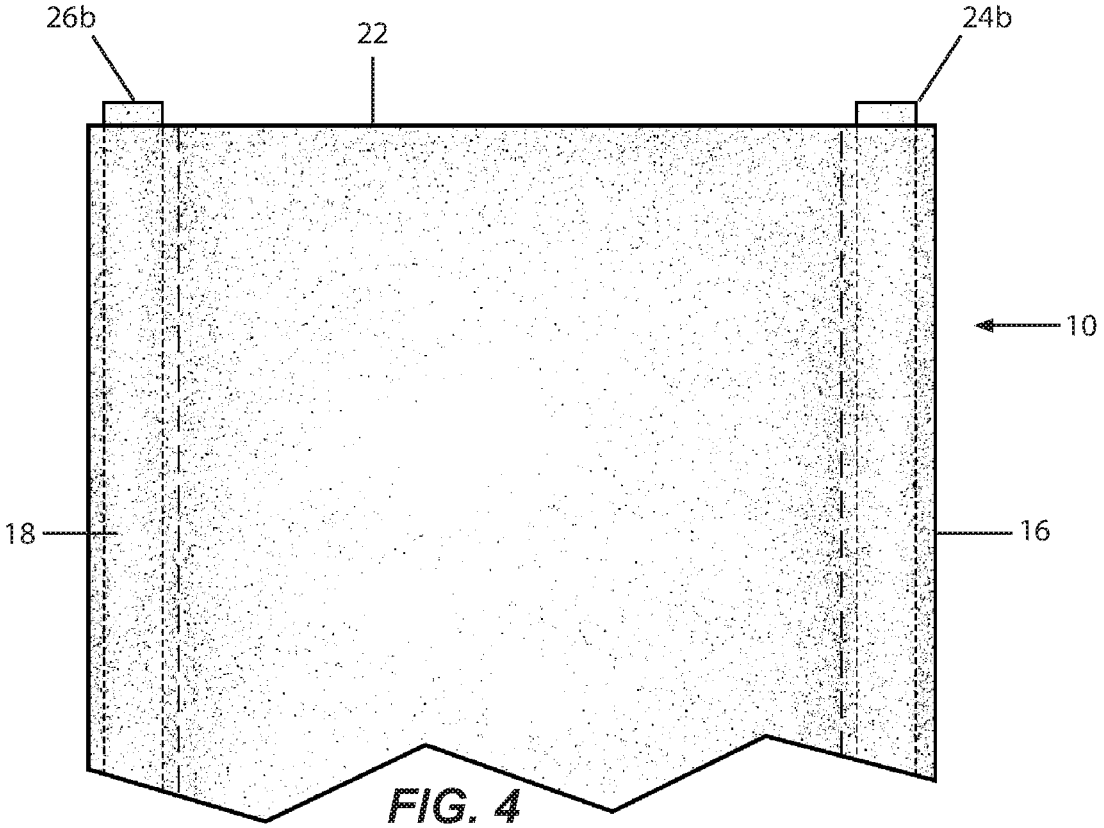
FIG. 4 is an enlarged, plan view of the right end portion of the towel in FIG. 1, as seen from the back side of the towel.

FIG. 1 is a view of a front side of a towel 10 according to the invention, and FIG. 2 is a view of the reverse side of the towel 10 in FIG. 1. The overall form, appearance, and dimensions of the towel 10 may resemble those of a conventional bath or beach towel when the towel 10 laid flat as in the drawing, and thus match the appearance of towels already owned by a user and stored at his or her home. The towel 10 can be made in various sizes appropriate for children and adults as listed, e.g., below.

| Age | Width (in.) | Length (in.) |
|---|---|---|
| 2 to 3 | 16 to 20 | 34 to 37 |
| 3 to 4 | 20 to 24 | 35 to 40 |
| 4 to 6 | 22 to 26 | 36 to 45 |
| 6 to 8 | 24 to 28 | 38 to 49 |
| adult | 26 to 34 | 50 to 65 |

Figure 5:
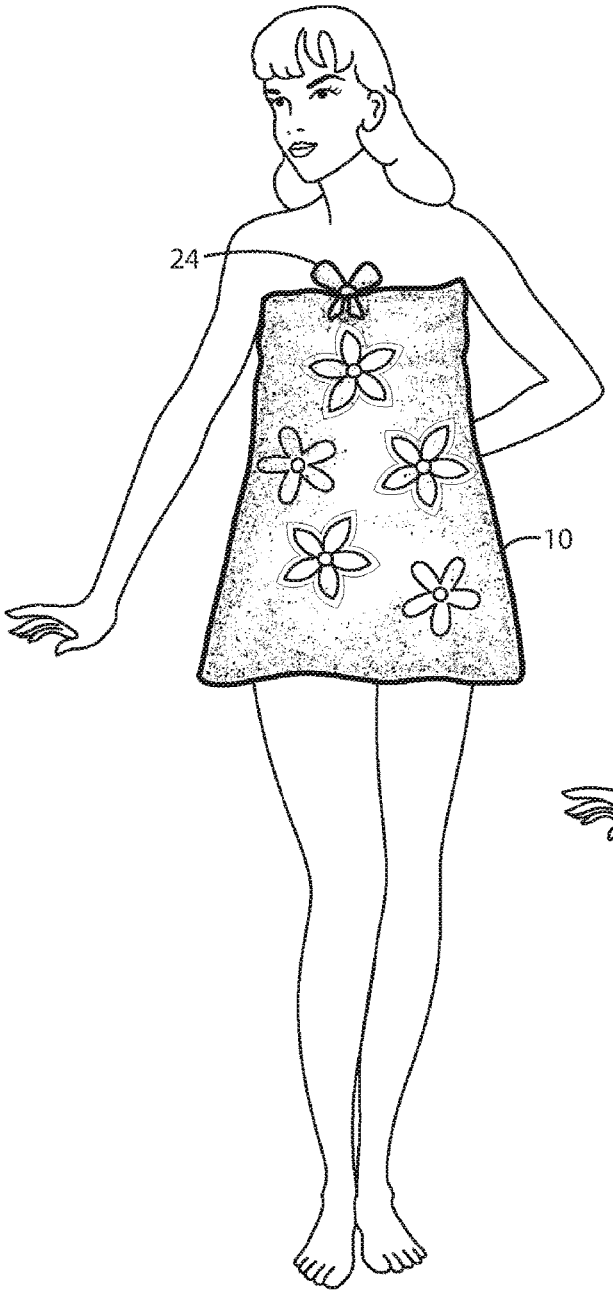
FIG. 5 is a view of the towel when worn as a garment about the chest of a user.
Figure 6:
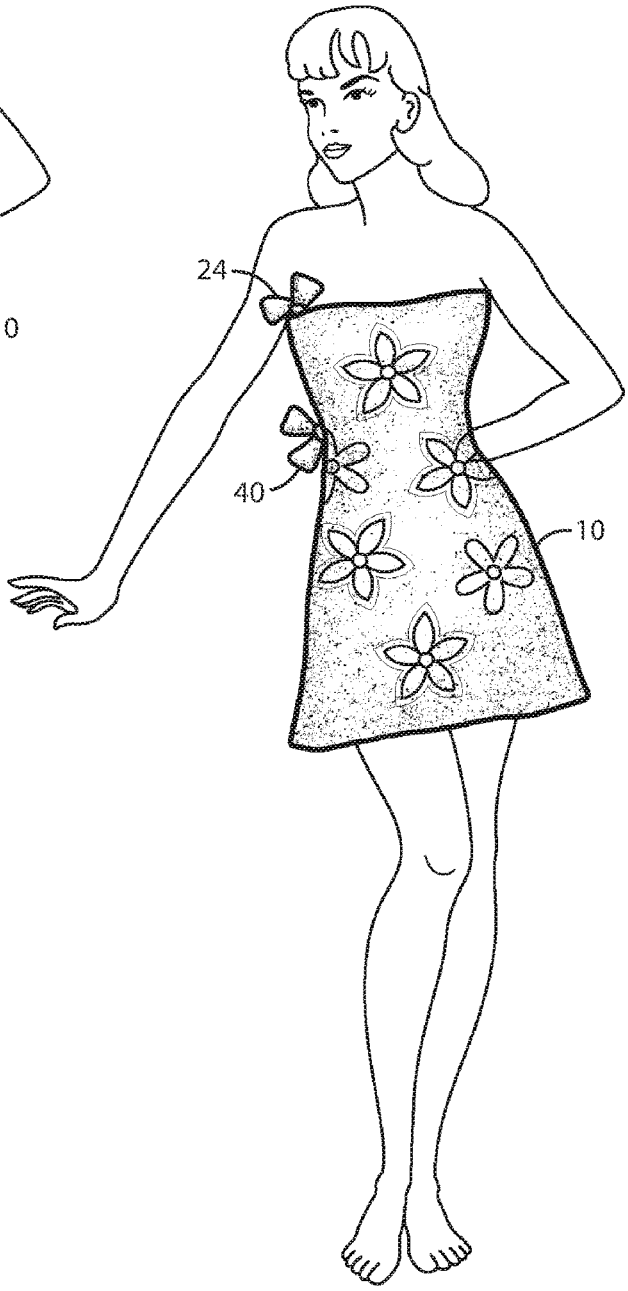
FIG. 6 is a view of the towel when worn as a dress by the user.
Figure 7:
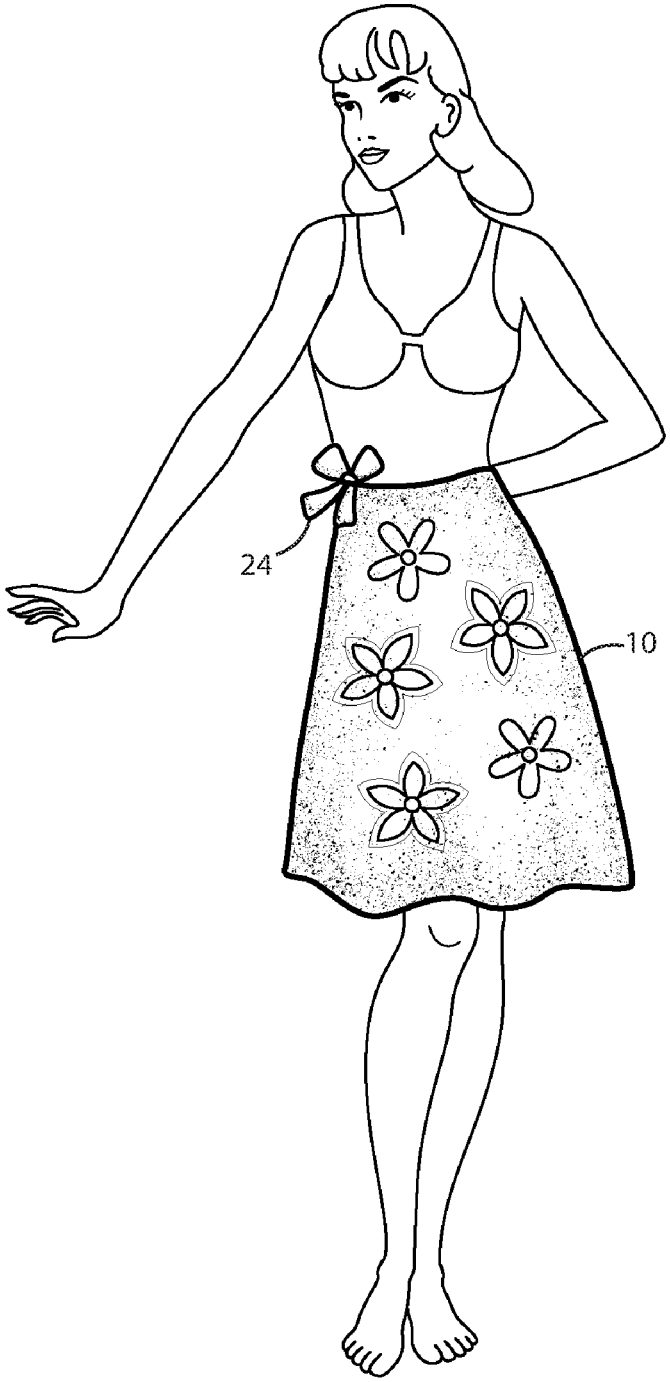
FIG. 7 is a view of the towel when worn as a skirt by the user.
Figure 8:
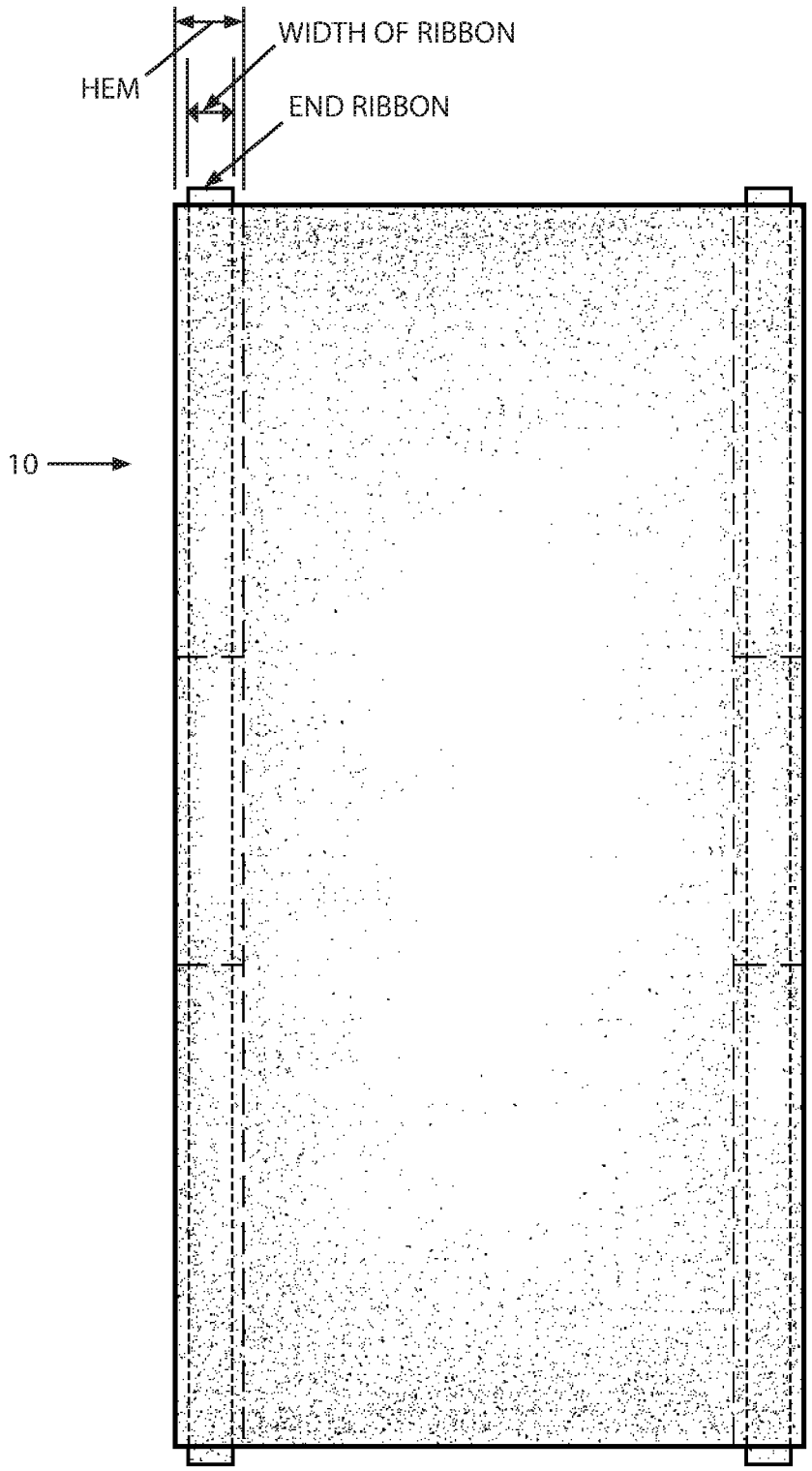
FIG. 8 is a plan view of the towel as in FIG. 1, defining certain dimensions.

The fabric from which the towel 10 is made can be selected from among, e.g., Egyptian cotton, pima cotton, or an organic cotton made from bamboo or cellulose from beech trees. The fabric should be pre-washed to avoid shrinkage. As seen in FIGS. 5, 6, and 7, and like conventional bath towels, the front side of the towel 10 may be imprinted a pleasing design or a solid color, as desired. As detailed below, the towel 10 also has a number of desirable features.

As shown in the drawing, the towel 10 has hems or sleeves 12, 14 that are formed, e.g., by stitches that run parallel to and are spaced a certain distance from the long edges 16, 18 of the towel 10. Opposite ends of the sleeves 12, 14 remain open at the short edges 20, 22 of the towel. When the towel 10 is laid flat, each sleeve 12, 14 is wide enough so that a length of a flat ribbon 24, 26 can also lie flat inside the sleeve over the length of the towel. The length of each ribbon 24, 26, is such that opposite ends 24*a* and 24*b*, and 26*a* and 26*b*, of the ribbons extend by a short distance (e.g., not more than one inch) beyond each sleeve so that the exposed ends of each ribbon can be held, and the short edges 20, 22 of the towel 10 can be pushed inward or gathered so that the towel can be wrapped closely about the wearer's body when the ribbons are tied. See FIGS. 5, 6, and 7. The use of flat ribbons 24, 26 ensures that the long edges 16, 18 of the towel 10 can lie flat when the ribbons are untied, and allows the towel to be stored conveniently among existing towels that the user may already possess. The ribbons 24, 26 can be made of polyester or other fabric that is pre-washed to prevent them from shrinking when the towel 10 is washed.

Depending on the size of the towel 10, the width of the ribbons 24, 26 may range from about one-quarter to two inches. To limit or avoid the exposure of the ribbon ends 24*a*, 24*b* and 26*a*, 26*b* at the short side of the towel 10 when the towel is laid flat or folded for storage, the ribbon ends may be thickened by folding them back one or more times, or by otherwise configuring the ribbon ends to coincide with the short edges of the towel 10 while prevent the ends from retracting inside the sleeves 12, 14 so as to become inaccessible to the user. For example, a short length of a loop material may be adhered to the ends of each ribbon, and a corresponding length of a releasable hook material adhered inside the ends of each sleeve to keep the ribbon ends in place until withdrawn by the user.

Each of the ribbons 24, 26 is also stitched or otherwise fastened directly to the towel 10, preferably at two locations 28*a*, 28*b*, and 30*a*, 30*b*, over the length of each sleeve 12, 14. By spacing the two stitch locations for each ribbon by at least 13 inches, the towel 10 can be prevented from gathering to such an extent as might choke or otherwise harm the wearer when the ribbons 24, 26 are exposed and tied to one another. The stitches also ensure that the ribbons cannot be completely withdrawn from the sleeves and possibly be lost, and that the ends of each ribbon are always accessible to the wearer.

As illustrated in FIGS. 5, 6, and 7, when a user steps out of a bath or shower, or while at the beach or a swimming pool, the user simply dons the towel 10, gathers the towel about the ribbons to conform to the user's body, and ties the exposed ends of the ribbons to one another. In FIG. 5, the towel is worn around the user's chest. In FIG. 6, a third ribbon 40 is provided in an associated sleeve midway between the sleeves 12, 14, so as to allow the user to gather and tie the towel about the waist as well. In FIG. 7, the towel is tied about the waist to be worn as a skirt, and will allow the user to sit comfortably on hot ground. And because each of the ribbons 24, 26 is stitched directly to the towel at two spaced locations as disclosed above, the towel 10 can be tied and worn safely around the user's neck to protect from wind or sun burn, or simply to keep warm.

It will be understood that once the towel 10 is securely tied about the user's body, the towel will stay in place and leave the user's hands free. Further, closing the towel about the user's body will guarantee privacy in locker room settings, leaving the user free to change with no towel slips.

As disclosed herein, it will be appreciated that while resembling an ordinary bath or beach towel in appearance, the inventive towel 10 can serve many different useful functions. For example:

1. As a tote or beach bag if items to be carried are placed, e.g., on the back side of the towel, and opposite ends of each ribbon 24, 26 are withdrawn from the sleeves 12, 14 and tied to form two handles.

2. As a garment like a skirt or dress, especially if a third sleeve with an associated ribbon are provided.

3. Inside a vehicle to provide shade for occupants by tying the towel between handles on doors or other fixed objects in or on the vehicle.

4. As a cover for a car seat, e.g., by tying one end of a ribbon around a head rest and placing the towel on the seat. As such, the towel will protect the user from hot and/or sticky seats.

5. Inside a vehicle to protect the steering wheel and front seats from heating by tying one end of the towel to the driver's side door handle and the other end to the passenger side door handle.

6. As a curtain for a small window by placing nails at opposites sides of the window, and forming loops at opposite ends of the ribbons for hanging on the nails.

7. As a tablecloth by placing the towel on a picnic table and attaching the ends of each ribbon to the legs of the table. This will allow the tablecloth to remain fixed on the table even in the presence of wind or if accidently pulled.

8. At a doctor's office or hospital. Because the towel can be tied around the chest or waist, across the front, the back, or the side of a patient, the towel allows a number of options for the doctor while providing privacy for the patient.

9. As a protective garment when the user is in a rush and must leave a location quickly, for example, a burning hotel, house, or building.

10. With folding chairs at the beach or pools to protect the user from hot or rough surfaces, and to prevent the user's knee, foot, or hand from slipping between the elastic strips forming the chair's surface. The towel can be laid down on the opened folding chair, and the ribbons tied to the chair frame to keep the towel in place.

While the foregoing description represents preferred embodiments of the inventive towel, it will be understood by persons skilled in the art that various changes, modifications, and additions can be made without departing from the spirit and scope of the invention. Accordingly, the invention includes all such changes, modifications, and additions to the towel disclosed herein.

I claim:

1. A body fitting towel, comprising: a generally rectangular absorbent fabric material having a pair of opposed edges and a pair of opposed short edges; first and second sleeves formed on the fabric material; a continuous ribbon disposed inside each sleeve, wherein each ribbon has two thickened ends wherein each thickened end is comprised of a ribbon end folded back upon itself and stitched to another portion of a corresponding one of said continuous ribbons to thicken the ribbon ends and to prevent the thickened ends from exceeding the towel length, wherein each thickened end is accessible by a user at an open end of a corresponding sleeve in which the ribbon is disposed, wherein the sleeves and ribbons extend along a peripheral length of the fabric material wherein the peripheral length of the fabric material is perpendicular to a width of the fabric material, and the thickened ends remain in place at the edges of the material until the thickened ends of the ribbon are accessed by the user, and each ribbon is stitched directly to one of the corresponding sleeves on the fabric material at two successive locations along the length of the corresponding ribbon, wherein the locations are spaced apart by a distance of at least 13 inches along the ribbon wherein the ribbons are configured so that the user of the towel can access the thickened ends of each ribbons and pull then around the user's body so that the thickened ends of each corresponding ribbon can be tied to one another; and a third sleeve formed on the fabric material, wherein the third sleeve is located intermediate the first and the second sleeves, and the third continuous ribbon is disposed inside the third sleeve, wherein the third ribbon has two ends, wherein each end is folded back upon itself and is stitched to another portion of the third ribbon to thicken the ribbon ends wherein each thickened end of the third ribbon is accessible by the user at open ends of the third sleeve.

2. A body fitting towel according to claim 1, wherein the fabric material including the sleeves and the ribbons are dimensioned so that the towel forms a garment when the user accesses the thickened ends of the ribbons and gathers the towel along the ribbons to conform to the user's body.

3. A body fitting towel according to claim 2, wherein the garment is a skirt or a dress.

4. A body fitting towel according to claim 1, wherein the fabric material including the sleeves and the ribbons are dimensioned so that the towel forms a tote for a beach bag when items to be carried are placed on the towel, and opposite thickened ends of each ribbon are accessed and tied to one another to form handles.

5. A body fitting towel according to claim 1, wherein each sleeve is wide enough so that when the towel is laid flat, each ribbon lies flat inside the sleeve in which the ribbon is disposed.

6. A body fitting towel according to claim 1, wherein the short edges of the fabric material are at least 16 inches in length, and the long edges of the fabric material are at least 34 inches in length.

7. A body fitting towel according to claim 1, wherein the short edges of the fabric material are about 26 inches in length, and the long edges of the fabric material are about 50 inches in length.

8. A body fitting towel according to claim 1, wherein each ribbon has a width in the range of from about one-quarter inch to two inches.

* * * * *